US006085555A

United States Patent [19]

Wu et al.

[11] Patent Number: 6,085,555

[45] Date of Patent: Jul. 11, 2000

[54] PALM-TOP FABRIC LEADING EDGE DETECTOR

[75] Inventors: Jong-Fu Wu; Kun-Lin Cheng, both of Taipei; Feng Biau Lin, Chia-Yi Hsien; Li-Jen Kuo, Tao-Yuan; Li-Jen Wang, San-Chung; Yu-Cheng Wang, Chung-Ho; Cheng-Chung Wang, Taipei, all of Taiwan

[73] Assignee: China Textile Institute, Taipei, Taiwan

[21] Appl. No.: 09/181,550

[22] Filed: Oct. 29, 1998

[51] Int. Cl.[7] ..... D06B 23/00

[52] U.S. Cl. ..... 68/13 R; 68/213; 68/235 R

[58] Field of Search ..... 68/13 R, 213, 68/214, 235 R

[56] References Cited

U.S. PATENT DOCUMENTS

| | | |
|---|---|---|
| 4,391,215 | 7/1983 | Sansone . |
| 4,580,512 | 4/1986 | Nakatani et al. . |
| 4,631,911 | 12/1986 | Young, Jr. et al. . |
| 4,799,442 | 1/1989 | Nakatani et al. . |
| 4,862,598 | 9/1989 | Barlow et al. . |
| 5,033,399 | 7/1991 | Miyachi et al. . |
| 5,042,410 | 8/1991 | Nakashima . |
| 5,282,298 | 2/1994 | Freerman . |
| 5,389,789 | 2/1995 | Nguyen . |
| 5,572,319 | 11/1996 | Blackman et al. . |
| 5,933,082 | 8/1999 | Abita et al. . |
| 6,029,325 | 2/2000 | Orzel . |

*Primary Examiner*—Frankie L. Stinson
*Attorney, Agent, or Firm*—Rosenberg, Klein & Lee

[57] ABSTRACT

A palm-top fabric leading edge detector adapted to be incorporated in a high temperature or regular temperature, L-configured or U-configured dyeing machine includes a detector body which is releasably connected to a sensor mounted in the dyeing machine via a cable to receive a fabric leading edge detection signal from the sensor when the leading edge of a fabric that is moved through the dyeing machine for dyeing passes through the sensor. The detector processes the fabric leading edge detection signal and provides the detection result on a display on the detector body. The detector is driven by an internal power source which may be primary cells or secondary cells rechargeable by means of external power source. Visual indicator and audio signal generation device are provided to indicate the detection of the fabric leading edge in a visual and audio manner.

8 Claims, 2 Drawing Sheets

PALM-TOP FABRIC LEADING EDGE DETECTOR

BACKGROUND OF THE INVENTION

1. Field of the Invention

The present invention relates generally to a palm-top fabric leading edge detector and in particular to a hand-held fabric leading edge detector comprised of simple operational elements, belonging to the field of fabric leading edge detection in a dyeing machine.

2. Related Arts

It is known to incorporate a fabric leading edge detection device in a dyeing machine, such as a batch type L-configured dyeing machine to detect the leading edge of the fabric that is being dyed. The conventional fabric leading edge detection device comprises a magnetic sensor mounted in the dyeing machine to detect the fabric leading edge which has a magnet fixed thereon and includes a sophisticated, basically non-movable structure to provides the functions of display of detection time, reset, fabric leading edge delay warning, count of numbers of detection, and overall detection time. However, most of the functions are not necessary for practical operation. The non-movable structure of the conventional device makes it impossible to cooperate with another dyeing machine so that each detection device may only be cooperate with a single dyeing machine. Further, such a sophisticated structure makes it expensive. Thus using the conventional fabric leading edge detector is in general in-economic.

It is thus desirable to provide a portable, palm-top fabric leading edge detector which may be operated in a hand held condition and readily and detachably connectable with dyeing machines to provide a more efficient and effective way of detecting the leading edge and moving speed of the fabric that is being dyed in the dyeing machine.

SUMMARY OF THE INVENTION

Thus, a principal object of the present invention is to provide a palm-top fabric leading edge detector which is readily and detachably connectable with a dyeing machine and may be operated by being held in a hand of the user for providing an efficient and effective way of detecting the leading edge and moving speed of the fabric being dyed in the dyeing machine.

Another object of the present invention is to provide a palm-top fabric leading edge detector which is readily disconnected from a first dyeing machine and connected to a second dyeing machine so that a single fabric leading edge detector may be used with a number of dyeing machines.

A further object of the present invention is to provide a fabric leading edge detector which is simple in structure and thus cheap in cost.

In accordance with the present invention, a palm-top fabric leading edge detector is provided, comprising a detector body sized to be held in the user's hand and connectable with a sensor that is mounted in the dyeing machine to detect the leading edge of the fabric that is being dyed in the dyeing machine via a cable which is connected to and extends from the sensor. The cable has a plug to be detachably connected to the detector to provide leading edge detection signal from the sensor to the detector so as to have the signal processed and the detection result displayed. The detector has a fabric leading edge indicator and an audio warning device to provide visual and sound indication of the detection of the fabric leading edge.

In accordance with the present invention, the fabric leading edge detector is powered by means of primary cells or secondary cells and may be held in the user's hand as a regular hand-held instrument so as to provide ease of use and maneuverability which allows a single detector to be used with a number of dyeing machines. The storage of the fabric leading edge detector requires only a limited space for its small size.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
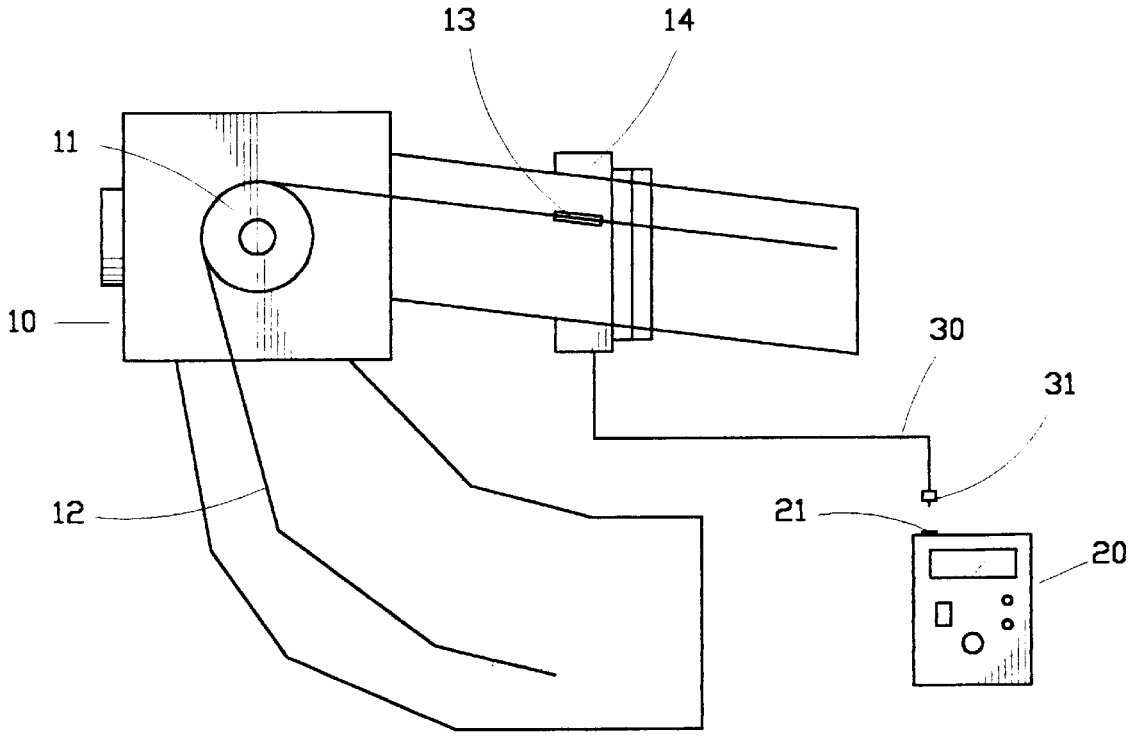
FIG. 1 schematically shows a palm-top fabric leading edge detector in accordance with the present invention incorporated in a dyeing machine.

With reference to the drawings and in particular to FIG. 1, wherein a dyeing machine, broadly designated at 10, is schematically shown to which a palm-top fabric leading edge detector, generally designated with reference numeral 20, is incorporated to detect the leading edge and the moving speed of a fabric 12 that is moving through the dyeing machine 10 for dyeing. The dyeing machine 10 may be of any suitable type, such as high temperature or regular temperature L-configured or U-configured dyeing machine.

As shown in FIG. 1 and generally known, the dyeing machine 10 comprises a fabric driving roller 11 which drives the fabric 12 to move through the dyeing machine 10 for performing dyeing operation. The fabric 12 has a leading edge to which a magnetic body 13 is attached. To detect the leading edge of the fabric 12, a sensor 14, preferably a magnetic sensor, is mounted in the dyeing machine 10 so that when the fabric 12 is moving through the dyeing machine 10, the magnetic body 13 on the fabric leading edge passes through the sensor 14 and causes a signal in the sensor 14 by means of magnetic interaction therebetween. The signal generated in the sensor 14 represents the detection of the fabric leading edge, which may be output in the form of an electrical signal, such as voltage, to be applied to and processed by the detector 20.

The magnetic body 13 may be any kind of suitable magnetic article, including rigid and flexible magnet and is fixed to the leading edge of the fabric 12 by means of for example seaming.

The detector 20 is electrically connected to the sensor 14 of the dyeing machine 10 by means of a cable 30 which has one end electrically connected to the sensor 14 and a second end having a plug 31 thereon. The plug 31 is electrically and mechanically engageable with a signal input port 21 formed on the detector 20 in a releasable or detachable manner to supply the fabric leading edge detection signal to the detector 20.

Figure 2:
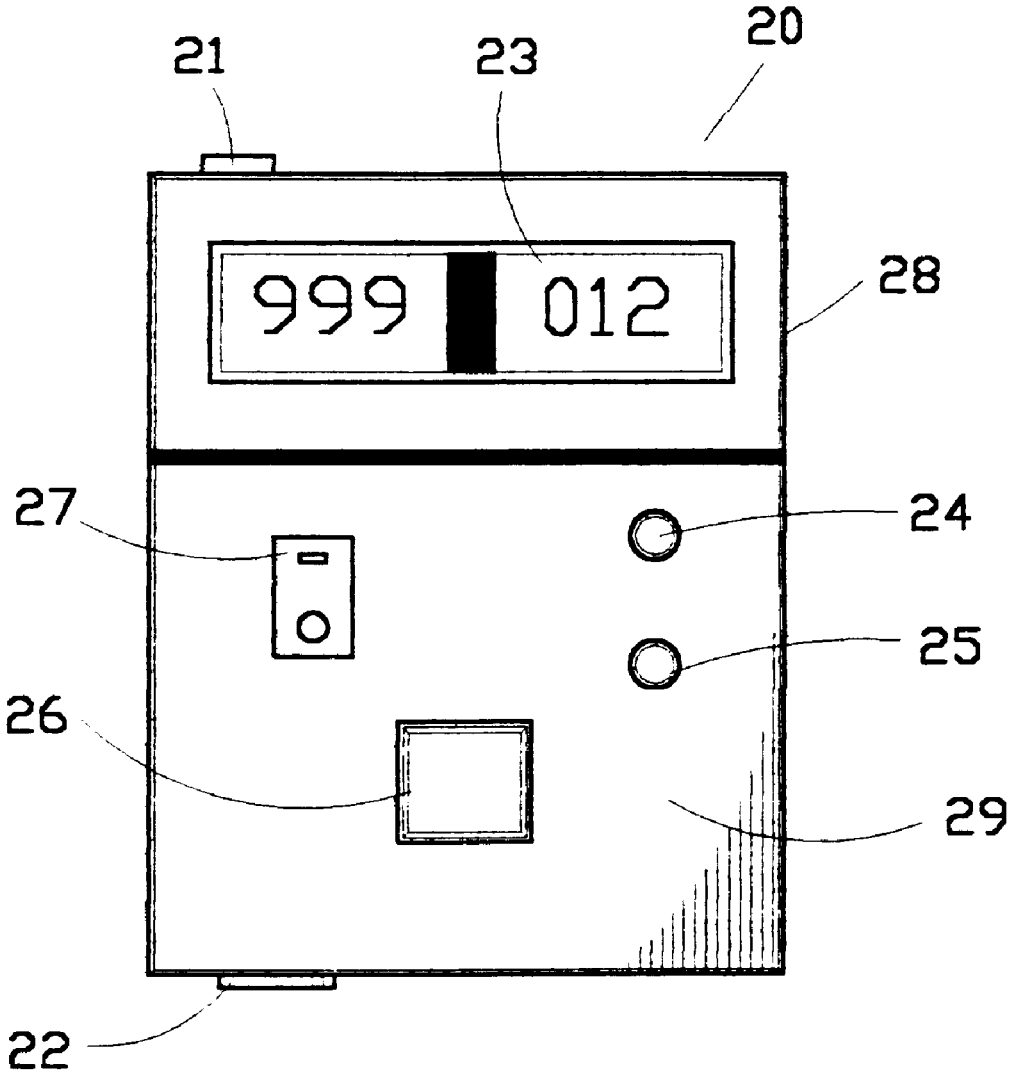
FIG. 2 schematically shows the palm-top fabric leading edge detector of the present invention.

The detector 20 is more clearly shown in FIG. 2, comprising a body 28 sized to be held by the palm of a user's hand on which the signal input port 21 is mounted to connect the plug 31 of the cable 30. The detector body 28 also has a power inlet 22 for connection with external power source, such as 110V AC main. The detector 20 may be driven by the external power source, but preferably, the detector 20 comprises an internal or built-in power source so as to provide maneuverability to the detector 20. The internal power source may be primary cells, but preferably the internal power source comprises rechargeable or secondary cells which may be re-charged by the external power source through the power inlet 22.

The detector 20 also comprises a display 23, preferably an LED (light emitting diode) display mounted on a front panel 29 of the detector body 28 to display the detection result which may includes information of the fabric leading edge detected and the time of the previous run and current run of the movement of the fabric 12 in the dyeing operation, preferably in terms of seconds. A fabric leading edge indicator 24 and a recharge indicator 25 mounted on the front panel 29 to respectively indicate the detection of the fabric leading edge and the charging status of battery. A reset switch 26, also mounted on the front panel 29, is used to reset the display 25. A power-on switch 27 is provided on the front panel 29 for turning on/off the detector 20.

The detector 20 comprises a suitable circuit which, when receiving the fabric leading edge detection signal from the sensor 14 via the cable 30, amplifies the signal by means of for example a Hall IC (integrated circuit) and filters out noise from the fabric leading edge detection signal with for example capacitor-based circuitry. The fabric leading edge detection signal also triggers the palm-top fabric leading edge detector 20 to light on the indicator 24 to indicate the detection of the fabric leading edge in a visual way.

The fabric leading edge detector 20 may also comprises an audio warning device (not shown), such as a buzzer, disposed inside the detector body 28 which is also triggered by the fabric leading edge detection signal to an audio indication of the detection of the fabric leading edge.

The information of the detected fabric is shown on the display 23 and the time periods in terms of seconds of the previous and current runs of the movement of the fabric in the dyeing machine are also shown in the display which allows automatic setting of the fabric leading edge signal cycle time.

As mentioned previously, the palm-top fabric leading edge detector 20 may have an internal power source which may be secondary cells so that the detector 20 may be charged by an external charging device (not shown). If an internal rechargeable power source is adapted and charged by means of for example 110V AC via the power inlet 22, then the detector 20 may be operable after a 4–5 hour recharge.

Alternatively, the internal power source may be primary cells. A DC 9V battery allows a two-hour continuous operation of the palm-top fabric leading edge detector 20.

The palm-top fabric leading edge detector 20 in accordance with the present invention has the following advantages:

1. The detector 20 is a small-sized, light-weighted, standard palm-top instrument, having beautiful outside configuration.
2. The detector 20 is easy to carry and stow, ready to use, and easy to recharge and requires only a low maintenance expense.
3. The detector 20 has an excellent detection capability and is more sensitive in detection and may provide a stable detection result.
4. One single piece of the fabric leading edge detector 20 may be used with a number of dyeing machines by selectively and alternately connected to these dyeing machines so as to provide a better economic interest.

Thus, the present invention provides a hand-held fabric leading edge detector having a simple structure which is novel and effective in achieving the desired functions and is easy to operate by the dyeing machine operator for enhancing the detection efficiency of detecting the fabric leading edge and the fabric speed.

Although a preferred embodiment has been described to illustrate the present invention, yet for those skilled in the art, it is possible to make a variety of modifications and changes to the specific embodiment without departing from the scope and spirit of the present invention. All these modifications and changes should be considered within the scope of the present invention as defined in the appended claims.

What is claimed is:

1. A palm-top fabric leading edge detector adapted to be incorporated in a dyeing machine to be electrically connected to a magnetic sensor in the dyeing machine via a cable to detect leading edge and moving speed of a fabric dyed in the dyeing machine, comprising:

a body sized to be hand held;

a signal input port mounted on the body to be releasably connected with the cable;

a power source for driving the palm-top fabric leading edge detector;

a display mounted on the body for displaying detection result;

a fabric leading edge indicator mounted on the body for visually indicating the detection of the fabric leading edge;

a reset switch mounted on the body for resetting the display; and a power on switch for turning on/off the palm-top fabric leading edge detector.

2. The palm-top fabric leading edge detector as claimed in claim 1, wherein the power source comprises is rechargeable power storage which is re-chargeable through a power inlet provided on the detector body.

3. The palm-top fabric leading edge detector as claimed in claim 2, wherein the detector body comprises a charging indicator which indicates charging condition of the rechargeable power storage.

4. The palm-top fabric leading edge detector as claimed in claim 2, wherein the rechargeable power storage comprises secondary cells.

5. The palm-top fabric leading edge detector as claimed in claim 1, further comprising an audio warning device disposed inside the body for providing an audio signal to indicate the detection of the fabric leading edge.

6. The palm-top fabric leading edge detector as claimed in claim 5, wherein the fabric leading edge indicator and the audio warning device serve as output means of the detection of the fabric leading edge.

7. The palm-top fabric leading edge detector as claimed in claim 1, wherein the dyeing machine to which the palm-top fabric leading edge detector is incorporated comprises high temperature or regular temperature, L-configured or U-configured dyeing machines.

8. The palm-top fabric leading edge detector as claimed in claim 1, wherein the detection result displayed on the display of the detector body comprises information of the detected fabric leading edge and time periods of previous and current runs of movement of the fabric in the dyeing machine.

* * * * *